US010265838B2

(12) United States Patent
Kolvick et al.

(10) Patent No.: US 10,265,838 B2
(45) Date of Patent: Apr. 23, 2019

(54) REMOVAL TOOL

(71) Applicant: General Electric Company, Schenectady, NY (US)

(72) Inventors: Sandra Beverly Kolvick, Simpsonville, SC (US); Stuart Craig Hanson, Anderson, SC (US); Wayne David Sullivan, Wilmington, NC (US)

(73) Assignee: General Electric Company, Schenectady, NY (US)

( * ) Notice: Subject to any disclaimer, the term of this patent is extended or adjusted under 35 U.S.C. 154(b) by 275 days.

(21) Appl. No.: 15/082,151

(22) Filed: Mar. 28, 2016

(65) Prior Publication Data

US 2017/0274510 A1 Sep. 28, 2017

(51) Int. Cl.

| | |
|---|---|
| ***B25B 27/00*** | (2006.01) |
| ***B25B 27/02*** | (2006.01) |
| ***F01D 25/28*** | (2006.01) |
| ***F01D 5/00*** | (2006.01) |
| ***F01D 5/30*** | (2006.01) |
| ***F01D 11/00*** | (2006.01) |

(52) U.S. Cl.

CPC ..... *B25B 27/0028* (2013.01); *B25B 27/02* (2013.01); *F01D 5/005* (2013.01); *F01D 5/3007* (2013.01); *F01D 5/3015* (2013.01); *F01D 11/001* (2013.01); *F01D 11/005* (2013.01); *F01D 25/285* (2013.01); *F05D 2230/70* (2013.01)

(58) Field of Classification Search

CPC ... B25B 27/0028; B25B 27/02; F01D 11/005; F01D 11/001; F01D 5/3015; F01D 5/3007; F01D 5/005; F01D 25/285

See application file for complete search history.

(56) References Cited

U.S. PATENT DOCUMENTS

| | | | | |
|---|---|---|---|---|
| 3,673,668 | A | 7/1972 | Crook | |
| 4,078,290 | A | 3/1978 | Fletcher et al. | |
| 4,096,614 | A | 6/1978 | Brungard et al. | |
| 4,334,493 | A * | 6/1982 | Okawara | B01J 2/006 118/19 |
| 4,335,493 | A | 6/1982 | Shivers, Jr. et al. | |
| 5,181,440 | A | 1/1993 | Jagt | |
| 6,571,471 | B2 | 6/2003 | Hohmann | |
| 7,455,505 | B2 | 11/2008 | Hartmann et al. | |
| 8,117,727 | B2 | 2/2012 | McCarvill | |
| 8,864,453 | B2 | 10/2014 | Spracher et al. | |

(Continued)

OTHER PUBLICATIONS

Extended European Search Report and Opinion issued in connection with corresponding EP Application No. 17162084.2 dated Aug. 17, 2017.

(Continued)

*Primary Examiner* — Moshe Wilensky

(74) *Attorney, Agent, or Firm* — Ernest G. Cusick; Hoffman Warnick LLC

(57) ABSTRACT

A tool for removing a component from a turbomachine is provided. The tool includes a body having a connection portion for engaging the component. The tool additionally includes a force section connected to the body and configured to transfer a force to the connection portion in a direction at an acute angle relative to longitudinal axis of a dovetail slot of a rotor wheel adjacent to the component.

16 Claims, 10 Drawing Sheets

(56) References Cited

U.S. PATENT DOCUMENTS

| | | | |
|---|---|---|---|
| 2009/0265908 | A1 | 10/2009 | Corn et al. |
| 2010/0162546 | A1 | 7/2010 | Kalmar et al. |
| 2015/0218948 | A1 | 8/2015 | Bird |
| 2015/0260043 | A1 | 9/2015 | Holmes et al. |
| 2015/0328729 | A1 | 11/2015 | Holmes et al. |
| 2017/0191380 | A1 | 7/2017 | Kolvick et al. |

OTHER PUBLICATIONS

Non Final Office Action dated Dec. 13, 2017 for U.S. Appl. No. 14/988,223, filed Jan. 5, 2016; pp. 25.
Final Office Action dated May 3, 2018 for U.S. Appl. No. 14/988,223, filed Jan. 5, 2016; pp. 6.
Non-Final Office Action dated Oct. 16, 2018 for U.S. Appl. No. 14/988,223, filed Jan. 5, 2016; pp. 26.

* cited by examiner

REMOVAL TOOL

This application is related to application Ser. No. 14/988,223, filed on Jan. 5, 2016, currently pending.

FIELD OF THE DISCLOSURE

The present disclosure relates generally to a tool for removing a component from a turbomachine.

BACKGROUND OF THE DISCLOSURE

Industrial and power generation turbomachines include a casing that houses a turbine. The turbine includes a plurality of rotor blades, or buckets, positioned along a gas flow path through the turbine, the blades supported by a number of turbine rotor wheels. The rotor blades and wheels define a plurality of turbine stages. Turbomachines also include one or more combustors that generate hot gases. The hot gasses may pass through a transition piece toward the plurality of turbine stages. In addition to hot gases from the one or more combustors, gases at a lower temperature flow from a compressor toward a wheelspace of the turbine. The lower temperature gases provide cooling for the rotor wheels as well as other internal components of the turbine. In order to prevent hot gases from entering the wheelspace, the turbine includes near flow path seals arranged between adjacent rotor wheels or rotor blades. The near flow path seals may be configured to fit closely adjacent the rotor wheels or rotor blades to reduce the leakage of hot gasses from the gas path into the wheelspace.

Generally, each of the rotor blades for a given stage in the turbine are attached to the respective rotor wheel using a dovetail assembly—i.e., the base of the rotor blade has a shape that is complementary to a slot in the rotor wheel—allowing the dovetail end of the rotor blade to slide into the dovetail slot in the rotor wheel and be held in position during operation of the turbine. Additionally, in certain turbines the near flow path seals may be attached at their base to rotor wheels using a similar dovetail assembly. Such a construction can ensure proper alignment of the rotor blades and near flow path seals during operation of the turbomachine. However, once all of the near flow path seals are installed for a given seal member rotor, the base of the seals may not be easily accessible.

Such a construction may create some difficulty when, for example, a maintenance worker needs to remove one or more of the near flow path seals. Further, each dovetail slot in the near flow path seal rotor wheel may include a C-shaped seal in the root for sealing the slot. The C-shaped seal necessitates applying a high force to the near flow path seal to remove it from the dovetail slot. The removal of near flow path seals is currently carried out in three ways. In later stages of the turbomachine, space is sufficient to allow installation and use of a hydraulic operated removal system (such as disclosed in U.S. patent application Ser. No. 14/277,232, filed May 14, 2014, and currently pending). At early stages of many turbomachines, such as between first and second stages and second and third stages, the space constraints prohibit use of the hydraulic operated removal system for removal of near flow path seals. In these situations, in one approach, the removal process is performed by hand with the force applied with a hammer, which makes it nearly impossible to remove the near flow path seals without damaging the component and surrounding structure. In order to address this situation, US patent application publication 2015/0260043, filed Mar. 12, 2014, discloses a removal tool for near flow path seals that operatively slides into a dovetail in a rotor wheel adjacent to the near flow path seal as the tool pulls on the near flow path seal. This approach has been found to be non-functional for a number of reasons, most notably, because the path of the adjacent rotor wheel dovetail is misaligned with the ideal path in which to pull the seal to remove it from its dovetail. This approach can also cause damage to the seal.

BRIEF DESCRIPTION OF THE DISCLOSURE

Aspects and advantages of the disclosure are set forth below in the following description, or may be obvious from the description, or may be learned through practice of the disclosure.

In one exemplary embodiment of the present disclosure a tool for removing a component of a turbomachine, comprising: a body including a connection portion configured to engage the component; and a force section connected to the body and configured to transfer a force to the connection portion of the body in a direction at an acute angle relative to a longitudinal axis of a dovetail slot of a rotor wheel of the turbomachine.

In one exemplary aspect of the present disclosure a method for removing a component of a turbomachine, comprising: positioning a tool near an outer circumference of a rotor wheel of the turbomachine such that a connection portion of the tool contacts the component; and applying a force to the component of the turbomachine using the tool by applying the force to a force section of the tool, the force being transferred from the force section to the connection portion at an acute angle relative to a longitudinal axis of a dovetail slot of the rotor wheel of the turbomachine.

In another exemplary embodiment of the present disclosure an assembly for removing a component in a turbomachine, comprising: a first rotor wheel, the component being slidably coupled to the first rotor wheel; a second rotor wheel positioned adjacent to the first rotor wheel, the second rotor wheel defining a slot; and a removal tool including: a body including a connection portion configured to contact the component; and a force section connected to the body and configured to transfer a force to the connection portion of the body in a direction at an acute angle relative to a longitudinal axis of the slot of the second rotor wheel of the turbomachine.

These and other features, aspects and advantages of the present disclosure will become better understood with reference to the following description and appended claims. The accompanying drawings, which are incorporated in and constitute a part of this specification, illustrate embodiments of the disclosure and, together with the description, serve to explain the principles of the disclosure.

BRIEF DESCRIPTION OF THE DRAWINGS

A full and enabling disclosure of the present disclosure, including the best mode thereof to one skilled in the art, is set forth more particularly in the remainder of the specification, including reference to the accompanying figures, in which.

DETAILED DESCRIPTION OF THE DISCLOSURE

Figure 1:
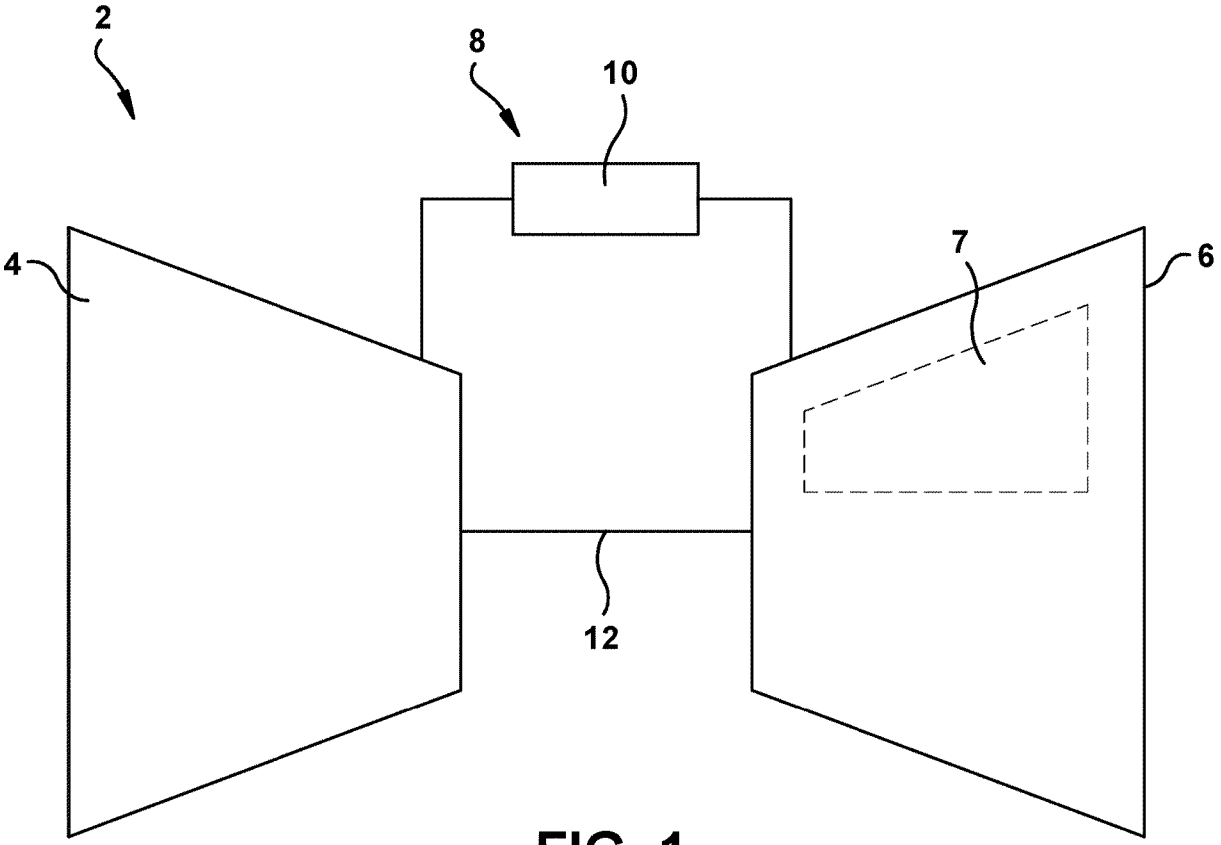
FIG. 1 is a functional diagram of an exemplary embodiment of a turbomachine of the present disclosure.

Reference now will be made in detail to embodiments of the disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the disclosure. For instance, features illustrated or described as part of one embodiment can be used with another embodiment to yield a still further embodiment. Thus, it is intended that the present disclosure covers such modifications and variations as come within the scope of the appended claims and their equivalents.

With reference to FIG. 1, a turbomachine 2 constructed in accordance with an exemplary embodiment of the present disclosure is generally provided. Turbomachine 2 includes a compressor portion 4 operatively connected to a turbine portion 6. A combustor assembly 8 is fluidly connected to compressor portion 4 and turbine portion 6. Combustor assembly 8 may be formed from a plurality of circumferentially spaced combustors, one of which is indicated at 10. It should be appreciated, however, that in other exemplary embodiments, combustor assembly 8 may include any other suitable arrangement of combustors 10.

Compressor portion 4 is also linked to turbine portion 6 through a common compressor/turbine shaft 12. With this arrangement, compressor portion 4 delivers compressed air to combustor assembly 8. The compressed air may mix with a combustible fluid to form a combustible mixture. The combustible mixture may then be combusted in combustor assembly 8 to form products of combustion that are delivered to turbine portion 6 through a transition piece (not shown). The products of combustion expand through turbine portion 6 to power, for example, a generator, a pump, an aircraft or the like (also not shown).

Figure 2:
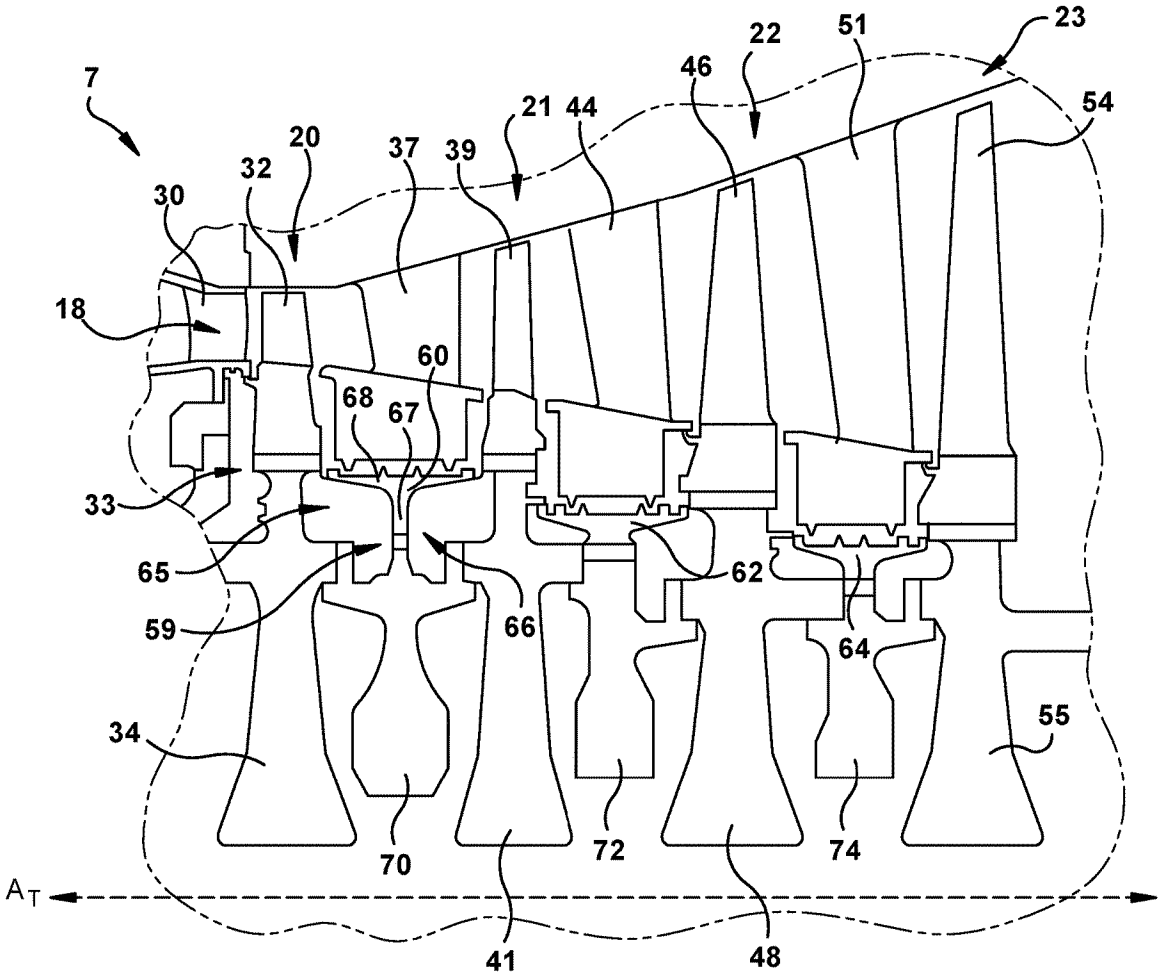
FIG. 2 is a cross-sectional view of a turbine portion of the exemplary turbomachine of FIG. 1.

A more detailed cross-sectional view of one section 7 of turbine portion 6 of FIG. 1 is provided in FIG. 2. As shown, turbine portion 6 includes first, second, third, and fourth stages 20, 21, 22 and 23 that define a gas path 18. First stage 20 includes a plurality of first stage stators 30, or nozzles, and a plurality of circumferentially arranged first stage rotor blades 32, or buckets, mounted to a first stage rotor wheel 34. Similarly, second stage 21 includes a plurality of second stage stators 37 and a plurality of circumferentially arranged second stage rotor blades 39 mounted to a second stage rotor wheel 41. In addition, third stage 22 includes a plurality of third stage stators 44 and a plurality of circumferentially arranged third stage rotor blades 46 mounted to a third stage rotor wheel 48. Finally, fourth stage 23 includes a plurality of fourth stage stators 51 and a plurality of circumferentially arranged fourth stage rotor blades 54 mounted to a fourth stage rotor wheel 55.

Figure 5:
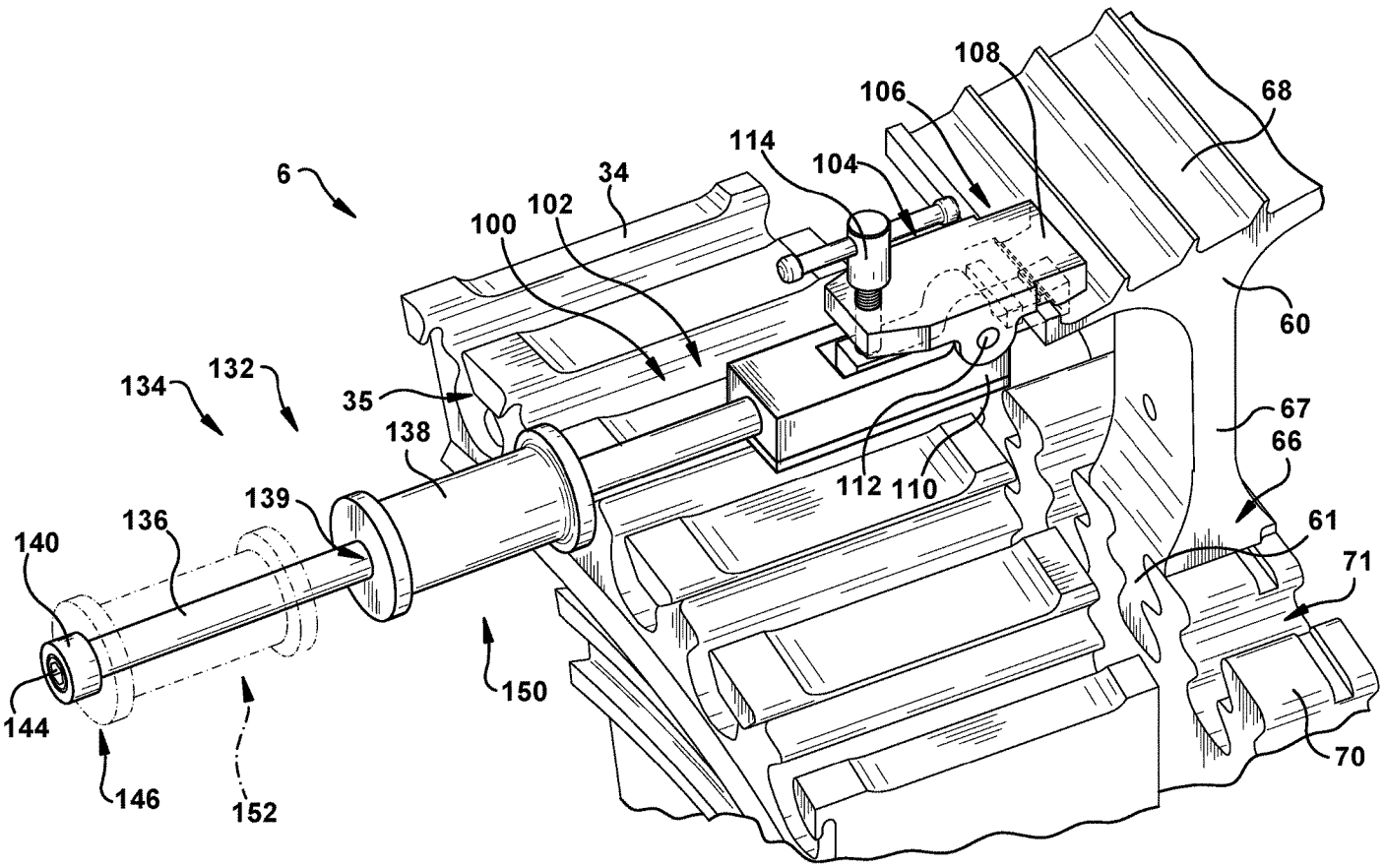
FIG. 5 is a perspective view of the removal tool positioned adjacent an outer circumference of a first stage rotor wheel of a turbine portion of an exemplary turbomachine.

At first stage 20 of turbine portion 6, rotor blades 32 are mounted to the respective rotor wheel 34 using a dovetail assembly. More particularly, rotor blade 32 includes a dovetail member 33 at a first end of rotor blade 32 and rotor wheel 34 defines a dovetail slot 35 (FIG. 5). Dovetail member 33 has a shape that is complementary to dovetail slot 35, such that rotor blade 32 may be mounted to or removed from rotor wheel 34 by sliding dovetail member 33 of rotor blade 32 generally along an axial direction $A_T$ of turbomachine 2 into dovetail slot 35 or out of dovetail slot 35. Second, third, and fourth stage rotor blades 39, 46, and 53 are similarly mounted to rotor wheels 41, 48, and 55, respectively.

Turbine portion 6 also includes a plurality of near flow path seal members 60, 62, and 64 arranged between adjacent ones of first, second, third, and fourth stages 20, 21, 22, 23 of turbine portion 6. Near flow path seal members 60, 62, 64 are mounted to seal member rotor wheels 70, 72, and 74 and are configured to prevent an exchange of gases between gas path 18 and a wheelspace 65 of turbomachine 2. More particularly, as indicated in FIG. 2, near flow path seal members 60 are circumferentially arranged between first stage 20 and second stage 21 of turbine portion 6, near flow path seal members 62 are circumferentially arranged between second stage 21 and third stage 22 of turbine portion 6, and near flow path seal members 64 are circumferentially arranged between third stage 22 and fourth stage 23 of turbine portion 6.

Figure 3:
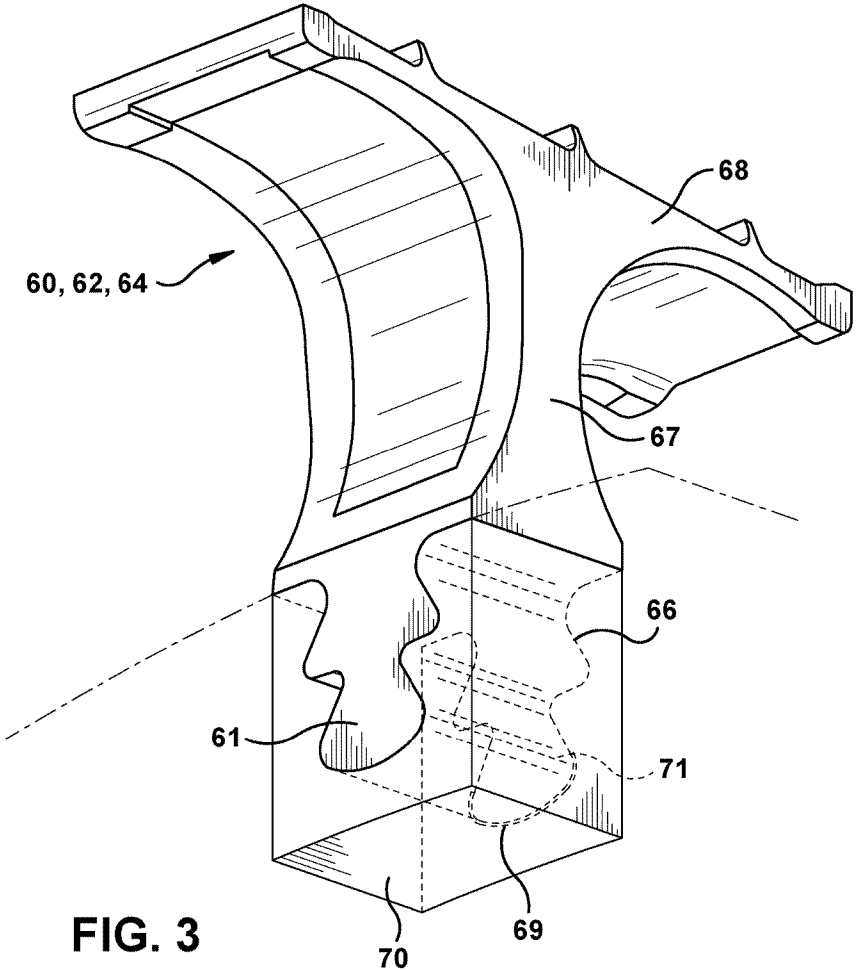
FIG. 3 shows a perspective view of the illustrative component of FIG. 2 partially removed from a rotor wheel.

Similar to the mechanism described for mounting rotor blades 32 to rotor wheel 43, as shown in FIG. 3, near flow path seal members 60 are mounted to seal member rotor wheel 70 using a dovetail assembly. More particularly, near flow path seal member 60 includes a dovetail member 61 at a first end 66 of seal member 60, and rotor wheel 70 defines a dovetail slot 71 (see also FIG. 5). Dovetail member 61 has a shape that is complementary to dovetail slot 71, such that near flow path seal member 60 may be installed or removed by sliding dovetail member 61 of near flow path seal member 60 generally along the axial direction $A_T$ (FIG. 1) of turbomachine 2 into dovetail slot 71 or out of dovetail slot 71. Each sliding dovetail member 61 may also include a C-shaped seal 69 thereon to provide additional sealing of sliding dovetail member 61 in dovetail slot 71 and inhibit easy sliding of sliding dovetail member 61. In addition, near flow path seal members 60 define a stem 67 extending from first end 66 to an outer sealing portion 68 that prevents the exchange of gasses. Near flow path seal members 62 and 64 are similarly mounted to seal member rotor wheels 72 and 74 (FIG. 2), respectively.

It should be appreciated, however, that in other exemplary embodiments of turbomachine 2, any suitable number of stages in turbine portion 6 may be provided. For example, in other exemplary embodiments, turbine portion 6 may only include three stages, i.e., three stages of rotor blades and rotor wheels, with two sets of near flow path seals positioned therebetween.

When removing near flow path seals 60, it may generally be preferable to apply a force directly to first end 66 of seals 60 so as to minimize any moment created on stem 67. However, due to the position of near flow path seals 60 and rotor wheel 70 relative to first and second stage rotor wheels 34, 41 (FIG. 2), it may be difficult to access first end 66 of seals 60 when all of circumferential seals 60 are mounted to rotor wheel 70. Accordingly, in order to assist in removal of near flow path seals 60, with reference now to FIG. 4, an exemplary tool 100 is provided, constructed in accordance with an exemplary embodiment of the present disclosure. As will be explained in greater detail with reference to FIGS. 4, 5, and 6, below, tool 100 is configured to assist a user in exerting a force on near flow path seals 60, in contrast to conventional tools, in a variety of angles, including but also not limited to a linear direction aligned with dovetail slot 35 in rotor wheel 34. In this fashion, tool 100 allows reliable removal of near flow path seals 60 and minimizes any damage to near flow path seals 60 and adjacent structure during removal.

Figure 4:
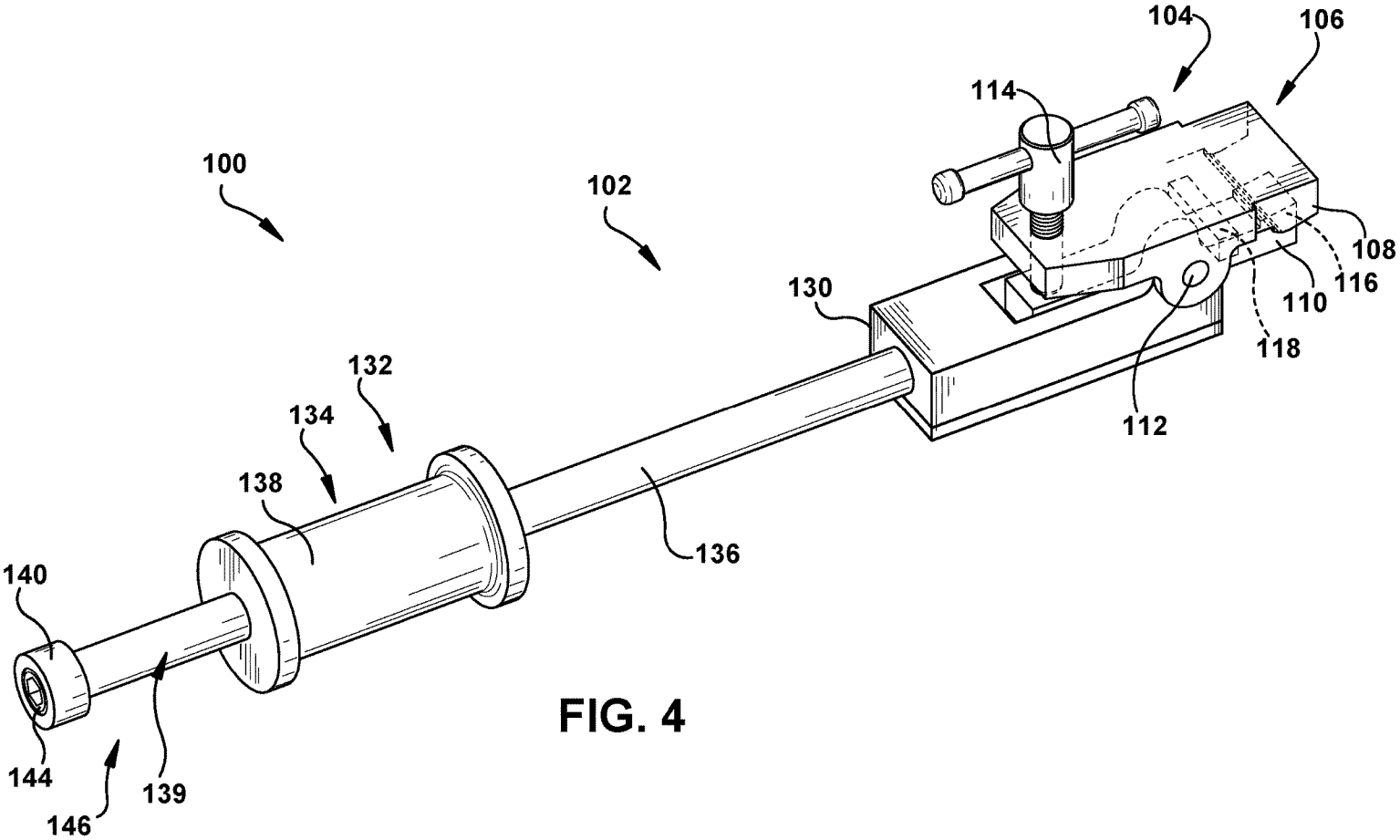
FIG. 4 is a perspective view of one embodiment of a removal tool of the present disclosure.
Figure 6:
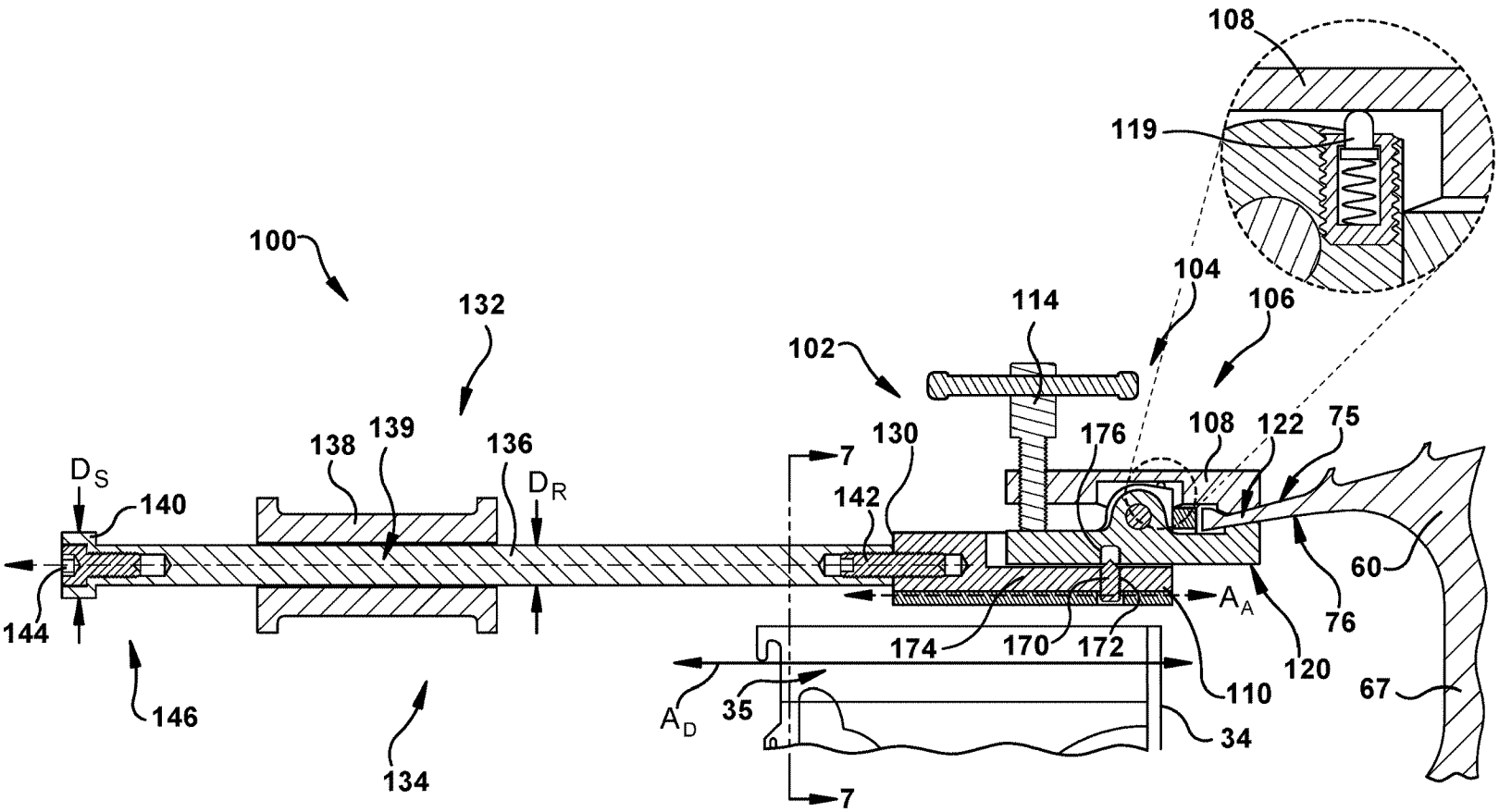
FIG. 6 is a cross-sectional view along a longitudinal axis of a body of the removal tool of FIG. 4, positioned in the first stage rotor wheel of the turbine portion of the exemplary turbomachine.
Figure 8:
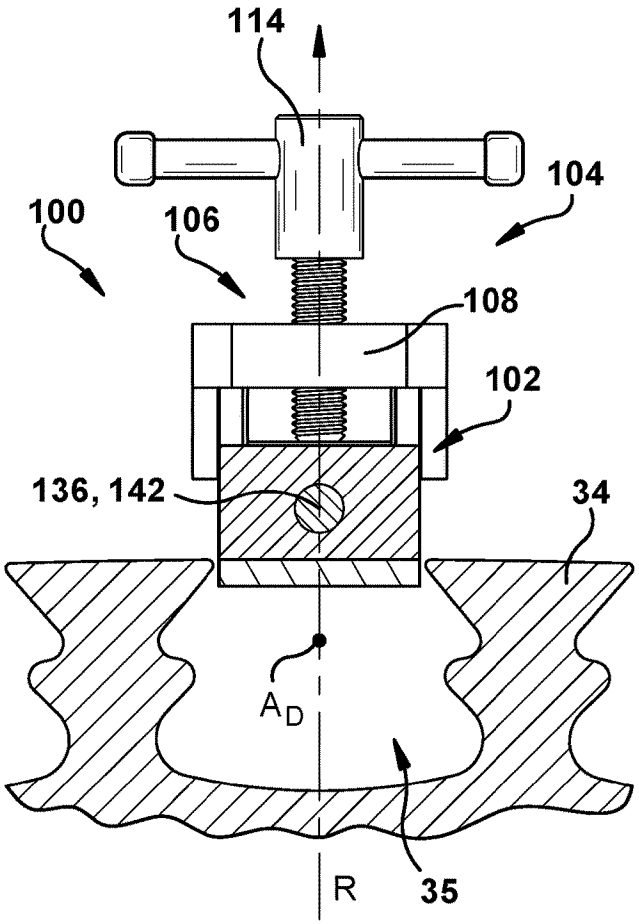
FIG. 8 is a cross-sectional view of the removal tool of FIG. 6 along line 6-6 shown in FIG. 6 positioned over an outer circumference of a rotor wheel and angled radially inwardly.
Figure 7:
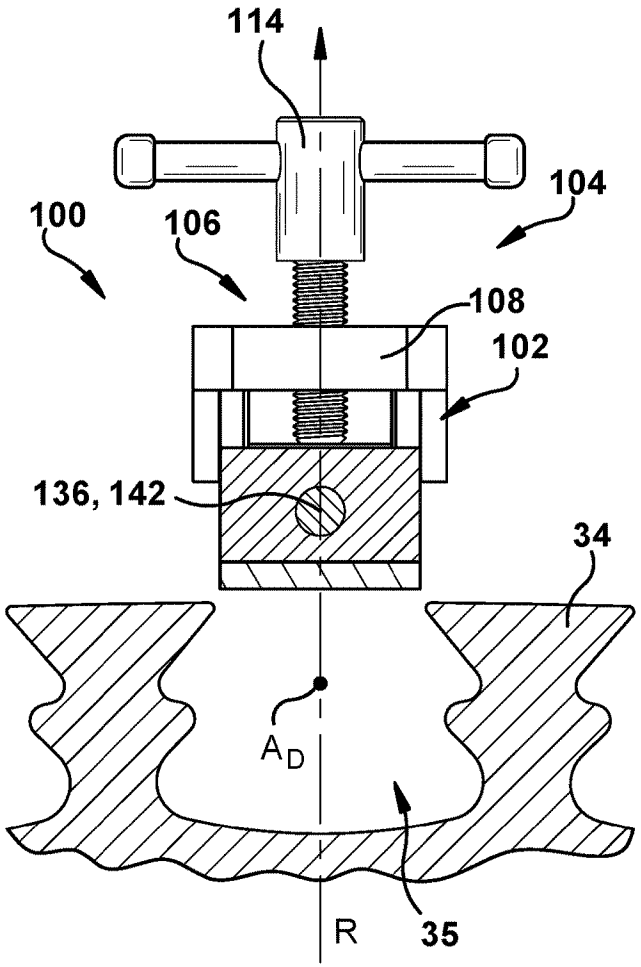
FIG. 7 is a cross-sectional view of the removal tool of FIG. 6 along line 6-6 shown in FIG. 6 positioned over an outer circumference of a rotor wheel.
Figure 9:
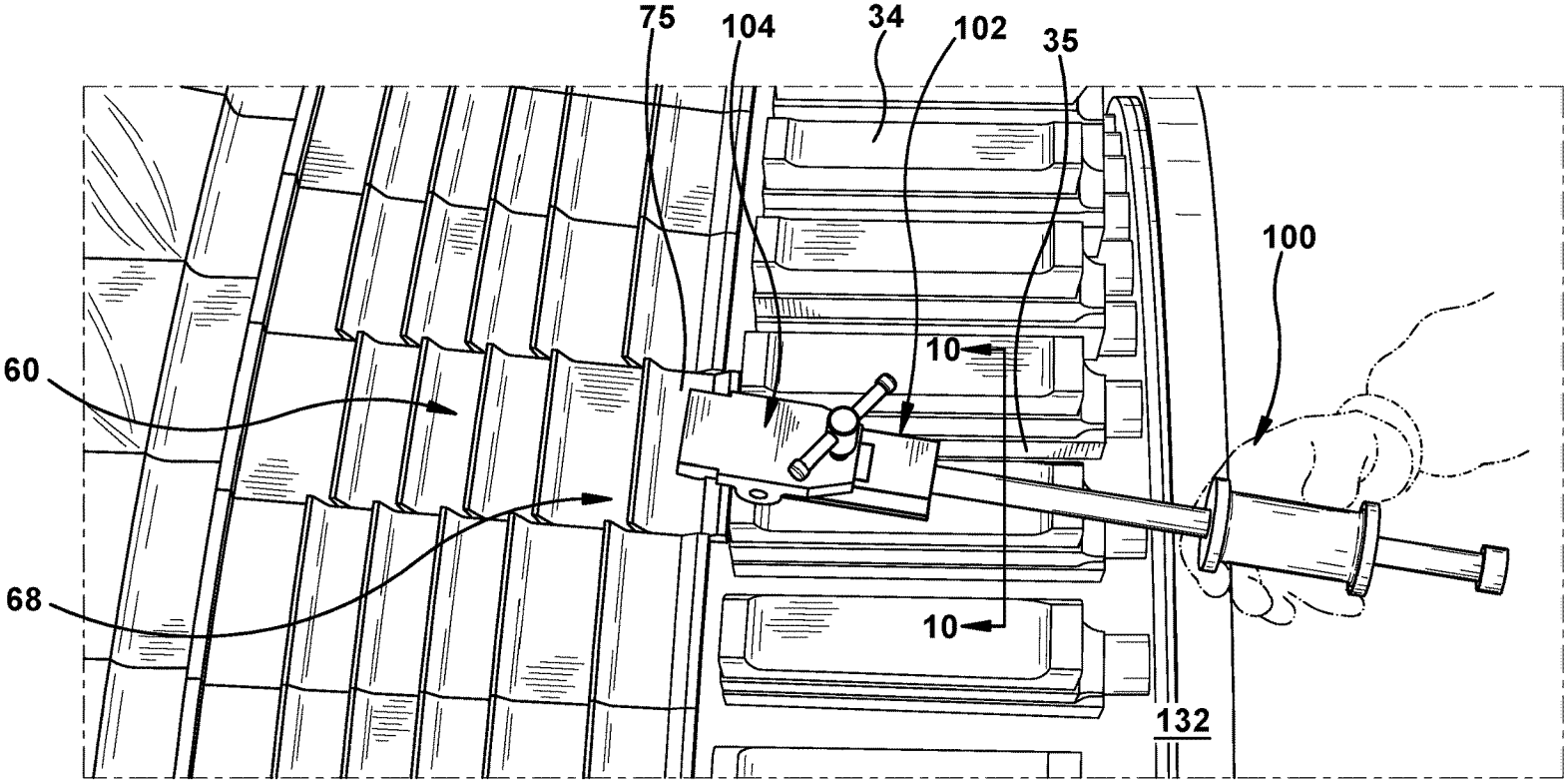
FIG. 9 is a perspective plan view of the removal tool in position adjacent to an outer circumference of a rotor wheel, and angled relative to a dovetail slot thereof.
Figure 10:
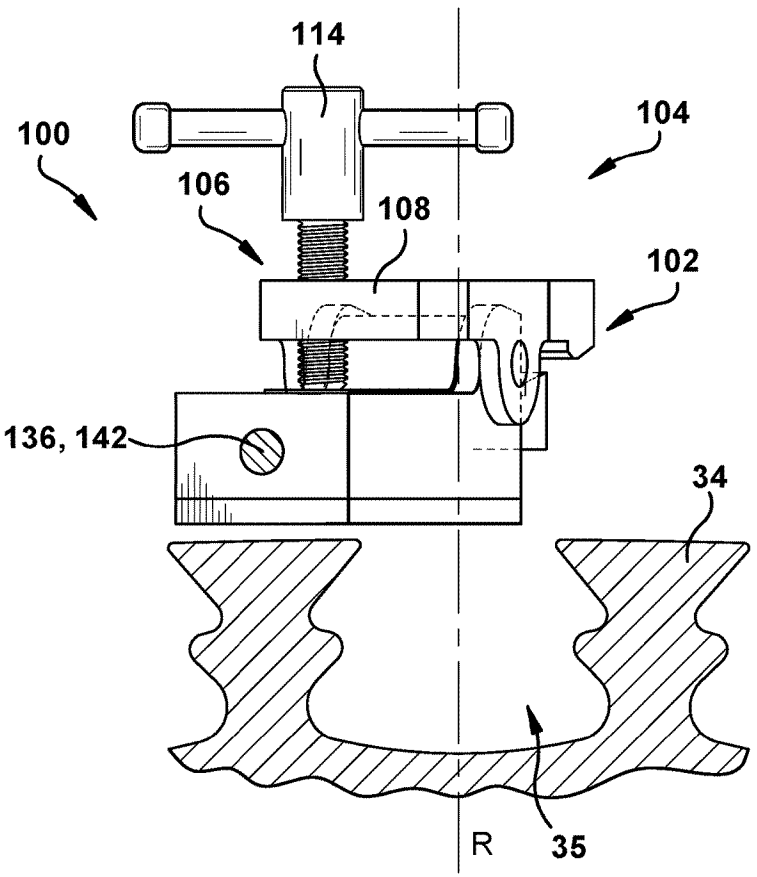
FIG. 10 is a cross-sectional view of the removal tool of FIG. 9 along line 9-9.

Referring now to FIGS. 5-10, exemplary tool 100 of FIG. 4 is shown positioned in various non-sliding engagement positions relative to a dovetail slot 35 defined in first stage rotor wheel 34. In each of these embodiments, tool 100 is positioned outwardly of an outer circumference of rotor wheel 34. Tool 100 is also shown attached to near flow path seal 60 positioned between first and second stages 20, 21 of turbine section 6. FIG. 5 provides a perspective view of tool 100 aligned in a radial plane but not parallel to an longitudinal axis of dovetail slot 35; FIG. 6 provides a cross-sectional view along a longitudinal axis $A_A$ of tool 100 with tool aligned in a radial plane and parallel to a longitudinal axis of dovetail 35 (and an outer circumference of rotor wheel 34); FIG. 7 provides a cross-sectional view of tool 100 along line 6-6 in FIG. 6 showing tool 100 radially outside of but aligned with a radial plane R of dovetail slot 35 and extending parallel to a longitudinal axis of dovetail slot 35 (into and out of page); FIG. 8 provides a cross-sectional view of tool 100 similar to FIG. 7 but showing portions of tool 100 within dovetail slot 35, i.e., tool 100 is not longitudinally aligned with the axis dovetail slot 35; FIG. 9 provides a perspective plan view of tool 100 with the tool radially outside of and unaligned with a radial plane or a longitudinal axis of dovetail slot 35; and FIG. 10 shows a cross-sectional view of tool 100 similar to FIGS. 7 and 8 but in the position shown in FIG. 9.

Tool 100 generally includes a body 102 and a force section 132. In contrast to conventional tools, tool 100 does not include a portion that aligns it, or slidingly engages it, to dovetail slot 35. Rather, body 102 is circumferentially sized, i.e., in a direction about rotor wheel 34, to either not fit into dovetail slot 35, or to readily move into and out of dovetail slot 35. Accordingly, when body 102 is positioned within dovetail slot 35, body 102 of tool 100 may only move in a direction generally parallel to the longitudinal axis $A_A$ body 102. However, body 102 may also be positioned at a large number of positions radially outward of dovetail slot 35 that allows body 102, and the force applied thereto and to seal 60, to be applied along a variety of directions, easing removal.

Body 102 of tool 100 additionally includes a connection portion 104 configured to contact the component, i.e., engage the component. For the exemplary embodiment of FIGS. 4, 5, and 6, connection portion 104 comprises a clamp 106 configured to removably attach tool 100 to near flow path seal 60. Clamp 106 includes a top member 108 and a bottom member 110, the bottom member 110 including, as shown in FIG. 4, a pad 116 and a back stop 118 mounted therein. For the exemplary embodiment shown, bottom member 110 is made as removably attached to body 102, e.g., by way of a threaded fastener 170 extending through an opening 172 in a bottom 174 of body 102 and threadably engaged in a threaded opening 176 in bottom member 110. It is understood that body 102 and bottom member 110 may be coupled in a variety of other manners, e.g., bottom member could be slid into body 102 and held in position by a detent, etc. In addition, clamp 106 includes a pin 112 extending through a midpoint of top member 110 to form a hinge and a screw 114 for tightening clamp 106 into a closed position, as shown in FIGS. 5 and 6. A spring member 119 is provided to bias clamp 106 towards an open position.

Clamp 106 defines an upper clamping surface 120 and a lower clamping surface 122 (see particularly FIG. 6). Upper and lower clamping surfaces 120, 122 are each defined at an angle relative to longitudinal axis $A_A$ of body 102, such that when clamp 106 is in a closed position, i.e., attached to near flow path seal 60, upper clamping surface 120 is substantially flush with an outer surface 75 of near flow path seal 60 and lower clamping surface 122 is substantially flush with an inner surface 76 of near flow path seal 60. Such a construction may assist in minimizing any damage to the near flow path seals during removal by minimizing the moment created on the stem 67 during removal.

It should be appreciated, however, that the construction of body 102 and connection portion 104 are by way of example only. In other exemplary embodiments of the present disclosure, tool 100 may have any other suitable design for body 102, connection portion 104, or both. Additionally or alternatively, the connection portion 104 may have any other design suitable for contacting the component, or attaching body 102 of tool 100 to the component. Furthermore, although the exemplary tool 100 is shown positioned radially outside of slot 35 defined in first stage rotor wheel 34 and attached to near flow path seal 60, in other exemplary embodiments of the present disclosure, tool 100 may be configured to be positioned relative to a dovetail slot defined by the second, third, or fourth stage rotor wheels 41, 48, or 55. In any of such exemplary embodiments, connection portion 104 of tool 100 may also be designed to attach tool 100 to any of the adjacent near flow path seals 62 or 64 at an appropriate angle such that the any damage to the near flow path seals is minimized during removal. Further, a set of clamps 106 may be provided, each clamp for selective coupling to body 102, e.g., using threaded fastener 170, and having a different sized clamping area between upper clamping surface 120 and lower clamping surface 122 than other clamps in the set of clamps.

Referring now particularly to FIGS. 5 and 6, the exemplary tool 100 further includes a force section 132 connected to body 102. Force section 132 is configured to transfer a force to connection portion 104 of body 102 in a direction dictated by a direction of body 102 and/or rod 136 relative to, for example, dovetail slot 35. As will be described herein, in contrast to conventional tools, the direction may be at an acute angle relative to a longitudinal axis $A_D$ of dovetail slot 35 of rotor wheel 34 of turbomachine 2. That is, the direction need not be aligned with a longitudinal axis of dovetail slot 35, which is aligned with an axis of turbomachine 2. For the exemplary embodiments of FIGS. 5 and 6, force section 132 comprises a slide hammer 134 attached to a rear end 130 of body 102. Slide hammer 134 includes a rod 136 attached to rear end 130 and defines a diameter $D_R$ and a longitudinal axis $A_R$ (FIG. 6). The longitudinal axis $A_R$ of slide hammer 134 is substantially parallel to the longitudinal axis $A_A$ of body 102. As may be seen in FIG. 6, rod 136 is attached to body 102 using a double threaded bolt 142 extending into body 102 and into rod 136.

Slide hammer 134 additionally includes a handle 138 defining a through hole 139, wherein rod 136 extends through the through hole 139 of handle 138. The shape of through hole 139 is complementary to the shape of rod 136, such that handle 138 may move freely along the longitudinal axis $A_R$ of rod 136. Further, slide hammer 134 includes a stopper 140 positioned at a distal end 146 of rod 136. Stopper 140 defines a diameter $D_S$ that is greater than the diameter $D_R$ of rod 136 and through hole 139, such that stopper 140 prevents handle 138 from sliding off rod 136. Stopper 140 is attached to rod 136 using, for example, a bolt 144, or other mechanism such as welding.

Such a construction may allow a user to generate a force by quickly transitioning handle 138 between a first position 150 adjacent to rear end 130 of body 102 (as shown in FIG. 5 in solid lines) and a second position 152 adjacent to stopper 140 (as shown in FIG. 5 in dotted lines). More particularly, a user may generate a force by moving handle 138 from first position 150 to second position 152, hitting stopper 140 with handle 138. When handle 138 contacts stopper 140, a force will be transferred from stopper 140 to rod 136, and from rod 136 to body 102 of tool 100. Such a force will be a pulling force in a direction away from connection portion 104 of body 102 and away from near flow path seal 60.

The direction of the force may take a variety of forms as illustrated in FIGS. 5-10, e.g., substantially parallel to a longitudinal axis $A_D$ (into page, FIGS. 6 and 7 only) of dovetail slot 35 or at a variety of acute angles. FIGS. 5-7 show an angle of body 102 and rod 136 aligned in a radial plane R (FIGS. 6-7 only) of dovetail slot 35. FIG. 6 shows an angle where body and rod 136 are aligned with radial plane R of dovetail slot 35 and are substantially longitudinally aligned with an axis $A_D$ of dovetail slot 35 of rotor wheel 34, i.e., such that the force would be applied parallel to dovetail slot 35. FIGS. 5 and 7, however, show body 102 and rod 136 extending in a radial plane aligned with radial axis R of dovetail slot 35 but angled radially inward relative to dovetail slot 35 at an acute angle relative to longitudinal axis $A_D$ of slot 35 (and turbomachine 2). In this position, as shown in FIGS. 5 and/or 8, portions of rod 136 and/or body 102 may extend partially into dovetail slot 35. In another example of a different angle, FIGS. 9 and 10 show rod 136 and body 102 at an acute angle relative to longitudinal axis $A_D$ of dovetail slot 35. Here the acute angle is relative to radial plane R, i.e., body 102 and/or rod 136 are not radially aligned with dovetail slot 35 and may or may not be angled radially inward (or outward) relative to dovetail slot 35. As can be appreciated, the acute angles presented are only illustrative, and tool 100 may be placed at any angle relative to dovetail slot 35 and/or seal 60 to apply a force to the seal. Further, while acute angling relative to longitudinal axis $A_D$ of slot 35 within radial plane R and laterally relative to radial plane R have been illustrated separately, it is emphasized that the direction applied may be a combination of various acute angles illustrated.

Figure 11:
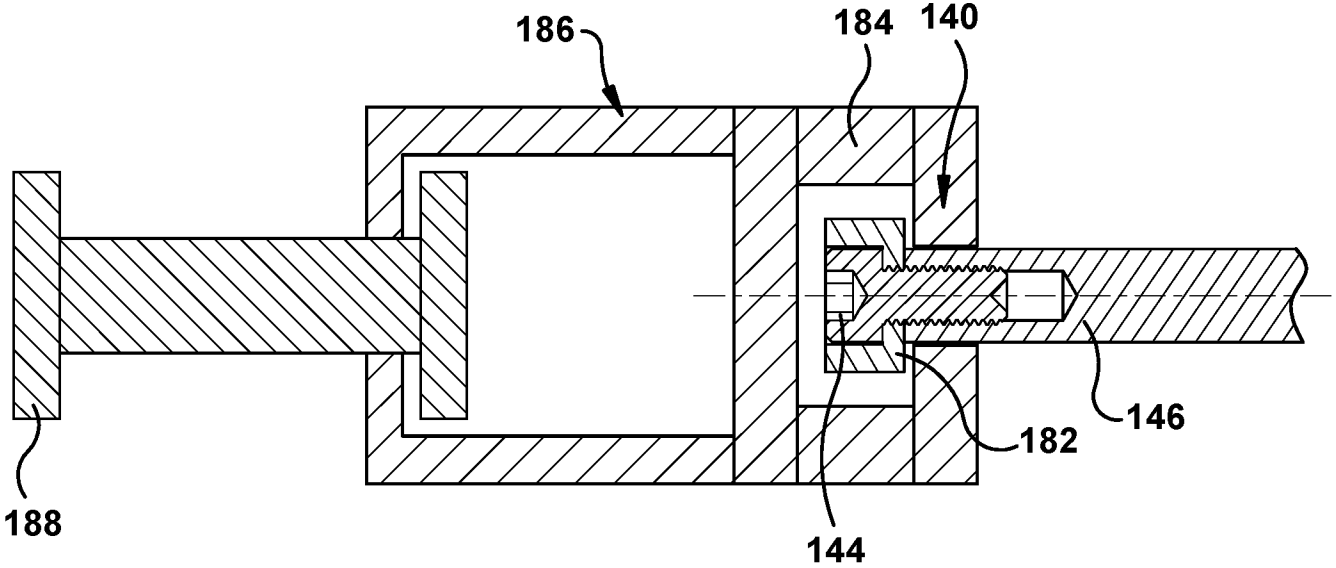
FIG. 11 is a cross-sectional view of a linear actuator connected to a stopper of the removal tool according to embodiments of the disclosure.

It should also be appreciated that in other exemplary embodiments, the tool 100 may include any other suitable force section 132. For example, in other exemplary embodiments, force section 132 may simply be a notch extending from body 102 of tool 100 configured to receive a force from an external source, such as a hammer or peening gun operated by a user, and transfer such force to body 102 of tool 100. Furthermore, rod 136 may take alternative forms. For example, rod 136 may include a set of rods, each rod for selectively coupling to body 102 and having a different length than other rods in the set of rods. In this fashion, along with perhaps different size clamps 106 as described herein, tool 100 can be custom sized for the particular stage of turbomachine at which it is to be applied and also the available access space at the respective stage. Rod 136 and handle 138 have a number of alternative shapes also. Stopper 140 may also take alternative forms. For example, as shown in FIG. 11, stopper 140 may include a coupling 182 configured to couple a portion 184 of a linear actuator 186. Coupling 182 may include a face of stopper 140 upon which portion 184 can engage, or any other structure for coupling to a linear actuator 186. Linear actuator 186 may include any form of coupling 188 on a distal end thereof to temporarily but fixedly couple or engage to a part of turbomachine 2 (FIG. 2) upon which the force to be applied to the component can be applied. Linear actuator 186 can take any now known or later developed linear actuator such as but not limited to a hydraulic ram, pneumatic ram, motorized worm gear, etc.

It should also be appreciated that although for the exemplary embodiment of FIGS. 5 and 6, tool 100 is shown exerting a pulling force on near flow path seal 60 towards a forward end of turbomachine 2, in other exemplary embodiments of the present disclosure, tool 100 may be configured to exert a pulling force on near flow path seal 60 towards an aft end of turbomachine 2.

As may be seen most clearly in FIGS. 5 and 6, tool 100 in combination with a first rotor wheel, i.e., the first near flow path seal rotor wheel 70, and a second rotor wheel positioned adjacent to rotor wheel 70, i.e., first stage rotor wheel 34, may include an assembly for removing a component, or near flow path seal 60, in turbomachine 2.

An exemplary method for removing a component of a turbomachine is also provided. The method may include positioning tool 100 near an outer circumference of rotor wheel 34, such that connection portion 104 of tool 100 contacts a near flow path seal 60, i.e., component. Rotor wheel 34 is positioned in turbine portion 6 of the turbomachine. For the exemplary method, positioning may include resting the tool on a portion of rotor wheel 34 or holding it suspended radially outward thereof. The method may also include attaching tool 100 to near flow path seal 60 using connection portion 104 of the tool. In certain exemplary embodiments of the present disclosure, connection portion 104 of the tool may include clamp 106, and attaching the tool to the near flow path seal may include attaching the clamp to the near flow path seal.

The method may further include applying a force to force section 132 of tool 100, such that the force is transferred from the force section to the connection portion. Portion(s) of tool 100 may interact with dovetail slot 35 defined in rotor wheel 34 such that the force is transferred to connection portion 104 in a direction substantially parallel to a longitudinal axis of dovetail slot 35. Alternatively, tool 100 may be radially outward of dovetail slot 35 and positioned at any angle to ease removal of seal 60 from its dovetail slot. The force applied to force section 104 may be applied using slide hammer 134, or a linear actuator 186. As shown, the method may further include sliding handle 138 of slide hammer 134 away from body 102 of tool 100 until the handle hits stopper 140. Such a step may allow slide hammer 134 to exert a pulling force on tool 100 in a direction away from the component, or near flow path seal 60. The force can alternatively be applied to stopper 144 by linear actuator 186. The exemplary method may further include applying the force to the component, or near flow path seal. In certain exemplary aspects, applying the force to the component may include transferring the force applied to force section 132 to body 102 of tool 100, or more particularly, transferring the force to connection portion 104 of the body of the tool in any desired angle selected by a user in positioning tool 100. The force may then be applied to the component. Such a process may allow for removal of the near flow path seal by pulling it out of the dovetail slot defined in the rotor wheel while minimizing any damage to the near flow path seal.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A tool for removing a component of a turbomachine, comprising:

a body;

a clamp releasably coupled to the body and configured to engage the component slidably coupled to a first rotor wheel of the turbomachine, the clamp including:

a bottom member removably attached to the body, the bottom member distinct from the body; and a top member pivotably and removably coupled to the bottom member, the top member distinct from the body; and a force section including a rod connected directly to the body, the force section configured to transfer a force to the clamp in a direction at an acute angle relative to a longitudinal axis of a dovetail slot of a second rotor wheel of the turbomachine.

2. The tool as in claim 1, wherein the component is a near flow path seal.

3. The tool as in claim 1, wherein the top member of the clamp defines an upper clamping surface and the bottom member of the clamp defines a lower clamping surface, and wherein in response to the clamp being in a closed position, the upper clamping surface is substantially flush with an outer surface of the component and the lower clamping surface is substantially flush with an inner surface of the component.

4. The tool as in claim 1, wherein the force section is configured to transfer a pulling force to the body of the tool in a direction away from the component.

5. The tool as in claim 1, wherein the force section comprises a slide hammer attached to a rear end of the body.

6. The tool as in claim 5, wherein the slide hammer comprises:

a handle defining a through hole, wherein the rod extends through the through hole of the handle; and a stopper positioned at a distal end of the rod, opposite the body, the stopper defining a diameter that is greater than a diameter of the rod.

7. The tool as in claim 6, wherein the stopper includes a coupling configured to couple a portion of a linear actuator to the force section.

8. An assembly for removing a component in a turbomachine, comprising:

a first rotor wheel, the component being slidably coupled to the first rotor wheel;

a second rotor wheel positioned adjacent to the first rotor wheel, the second rotor wheel defining a slot; and a removal tool including:

a body;

a clamp releasably coupled to the body and configured to contact the component slidably coupled to the first rotor wheel, the clamp distinct from the body and including:

a bottom member removably attached to the body, the bottom member distinct from the body; and a top member pivotably and removably coupled to the bottom member, the top member distinct from the body; and a force section including a rod connected directly to the body, the force section configured to transfer a force to the clamp in a direction at an acute angle relative to a longitudinal axis of the slot of the second rotor wheel of the turbomachine, wherein the bottom member and the top member of the clamp extends axially beyond the body toward the first rotor wheel.

9. The assembly as in claim 8, wherein the component comprises a near flow path seal, and wherein the clamp attaches the removal tool to the near flow path seal.

10. The assembly as in claim 9, wherein the clamp defines an upper clamping surface and a lower clamping surface, each defined at an angle relative to a longitudinal axis of a body of the clamp, and wherein in response to the clamp being in a closed position, the upper clamping surface is substantially flush with an outer surface of the near flow path seal and the lower clamping surface is substantially flush with an inner surface of the near flow path seal.

11. The assembly as in claim 10, further comprising:

a set of clamps, each clamp of the set of clamps releasably coupled to the body and having a different sized clamping area between the upper clamping surface and the lower clamping surface than other clamps in the set of clamps.

12. The assembly as in claim 8, wherein the force section comprises a slide hammer attached to a rear end of the body.

13. The assembly as in claim 12, wherein the slide hammer comprises:

a handle defining a through hole, wherein the rod extends through the through hole of the handle; and a stopper positioned at a distal end of the rod, opposite the body, the stopper defining a diameter that is greater than a diameter of the rod.

14. The assembly as in claim 13, wherein the stopper includes a coupling configured to couple a portion of a linear actuator to the force section.

15. The tool as in claim 13, wherein the force section further comprises a set of rods, each rod of the set of rods releasably coupled to the body and having a different length than other rods in the set of rods.

16. The assembly of claim 8, wherein the body of the removal tool is sized to be one of:

larger than the slot of the second rotor wheel to prevent the body from being positioned within the slot, or smaller than the slot of the second rotor wheel to prevent the body from being affixed within the slot.

* * * * *